US005127847A

United States Patent [19]

Kato et al.

[11] Patent Number: 5,127,847

[45] Date of Patent: Jul. 7, 1992

[54] CONNECTOR ENGAGEMENT DETECTING APPARATUS

[75] Inventors: Tetsuo Kato; Yoshihiro Murakami, both of Shizuoka, Japan

[73] Assignee: Yazaki Corporation, Tokyo, Japan

[21] Appl. No.: 674,237

[22] Filed: Mar. 25, 1991

[30] Foreign Application Priority Data

Mar. 27, 1990 [JP] Japan ..... 2-75699

[51] Int. Cl.[5] ..... H01R 3/00

[52] U.S. Cl. ..... 439/489; 439/357

[58] Field of Search ..... 439/345, 347, 350, 351, 439/352, 353, 354, 355, 357, 358, 488, 489

[56] References Cited

U.S. PATENT DOCUMENTS

| | | | |
|---|---|---|---|
| 4,602,839 | 7/1986 | Winger . | |
| 4,634,204 | 1/1987 | Detter et al. . | |
| 4,674,814 | 6/1987 | Hoshino et al. . | |
| 4,714,433 | 12/1987 | Rider, Jr. . | |
| 4,871,323 | 10/1989 | Ohsumi | 439/347 X |
| 4,900,267 | 2/1990 | Nagasaka et al. | 439/489 |
| 4,915,649 | 4/1990 | Shimazu et al. | 439/490 |
| 4,950,179 | 8/1990 | Takenouchi et al. | 439/352 |

FOREIGN PATENT DOCUMENTS 2221585A 2/1990 United Kingdom .

*Primary Examiner*—Larry I. Schwartz
*Assistant Examiner*—Khiem Nguyen
*Attorney, Agent, or Firm*—Armstrong, Nikaido, Marmelstein, Kubovcik & Murray

[57] ABSTRACT

Two mating connector housings are connected and locked together by a resilient lock arm formed on a first connector housing and an engagement portion formed on a second connector housing that cooperates with the resilient lock arm. The first connector housing is also provided with a lock verification slider that can be advanced toward the first connector housing only when the two connector housings are completely connected. A pair of engagement detection terminals are provided to either the first connector housing or the lock verification slider, and a short-circuit terminal is provided to either the lock verification slider or the first connector housing so that it faces the pair of engagement detection terminals. The pair of engagement detection terminals and the short-circuit terminal make up a connector engagement detection circuit. When the two connector housings are connected completely and the lock verification slider is advanced, the pair of engagement detection terminals and the short-circuit terminal are brought into contact with each other, completing the connector engagement detection circuit to indicate the full engagement of the mating connector housings.

4 Claims, 10 Drawing Sheets

CONNECTOR ENGAGEMENT DETECTING APPARATUS

BACKGROUND OF THE INVENTION

1. Field of the Invention

The present invention relates to a connector engagement detecting apparatus which has a means to determine whether or not a pair of mating connectors used for connection of automotive wiring harnesses are normally joined together.

2. Prior Art

In using an electrical connector which is composed of a pair of female and male connector housings, it is of the utmost importance that complete engagement of the pair is assured. Actually, however, incomplete engagement thereof takes place unnoticed so frequently that improper electrical connection results and the solution of this problem has been demanded.

SUMMARY OF THE INVENTION

The present invention has been accomplished to overcome the above drawback and its objective is to provide a connector engagement detecting apparatus which has a lock verification slider that electrically detects a complete engagement of mating connectors.

To achieve the above objective, a connector engagement detecting apparatus of this invention comprises: a first connector housing with a resilient lock arm; a second connector housing with an engagement portion that cooperates with the resilient lock arm of the first connector housing, said first and second connector housings being adapted to be joined together; a lock verification slider mounted to the first connector housing, said lock verification slider being able to be advanced only when the two connector housings are completely connected; a pair of engagement detection terminals provided to either the first connector housing or the lock verification slider; and a short-circuit terminal provided to either the lock verification slider or the first connector housing so that it faces the engagement detection terminals and, when the lock verification slider advances, comes into contact with the engagement detection terminals.

PREFERRED EMBODIMENTS OF THE INVENTION

Figure 1A:
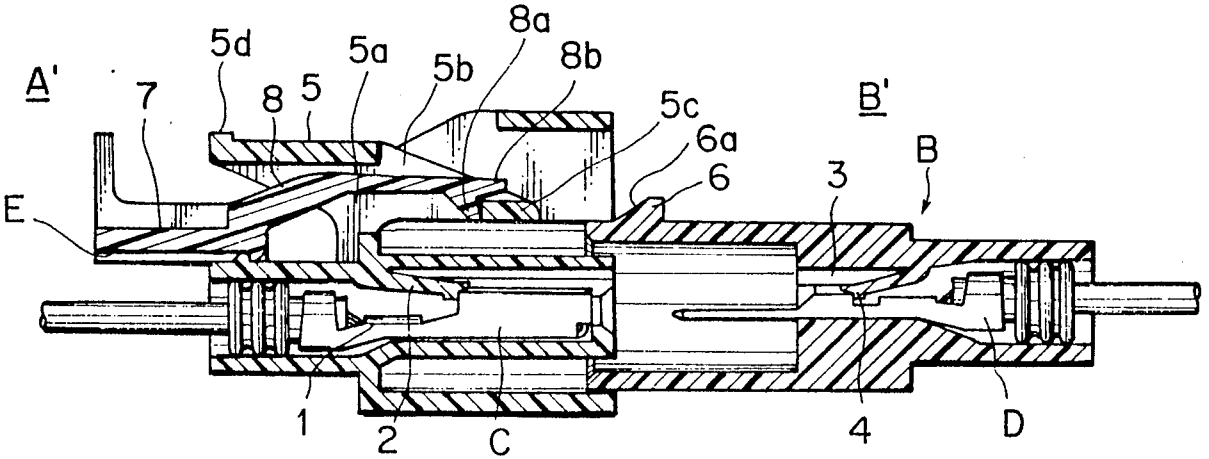
FIGS. 1*a*, 1*b*, 1*c*, 1*d*, 1*e*, 1*f* are cross-sectional views of the common structure of the male connector housing, the female connector housing and the lock verification slider in various embodiments of the present invention.

Referring to FIG. 1, reference symbol A' represents a male connector which consists of a male connector housing A that holds a female terminal C in a terminal accommodating chamber by a resilient engagement piece 2. Denoted B' is a female connector which consists of a female connector housing B that holds a male terminal D in a terminal accommodating chamber 3 by a resilient engagement piece 4.

The male connector housing A has a lock arm 5 formed on a resilient support 5*a* which has a slot 5*b* at the front half thereof and an engagement portion 5*c* formed at the front end of the slot 5*b*. The engagement portion 5*c* is adapted to engage with an engagement projection 6 formed on the surface of the female connector housing B. The lock arm is provided at the rear end with an unlock portion 5*d*.

The male connector housing A has a lock verification slider E, which is longitudinally movable. From a base portion 7 of the lock verification slider E projects a resilient lock detection arm 8 which has an abutment portion 8*a* and a support portion 8*b* at the front. The lock detection arm 8 extends into the slot 5*b* of the lock arm 5 with the abutment portion 8*a* abutting against the rear surface of the engagement portion 5*c* and with the support portion 8*b* contacting the upper surface of the engagement portion 5*c*. Before the male and female connector housings A, B are joined, as shown in FIG. 1*a*, the lock verification slider E is blocked by the engagement portion 5*c* of the lock arm 5 from moving forwardly.

Figure 1B:
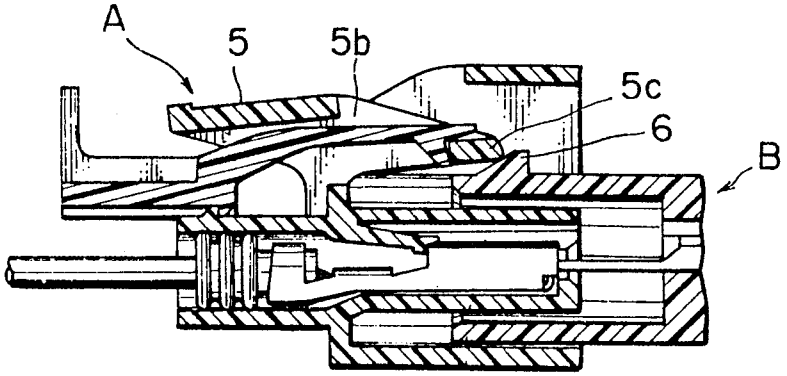
Figure 1C:
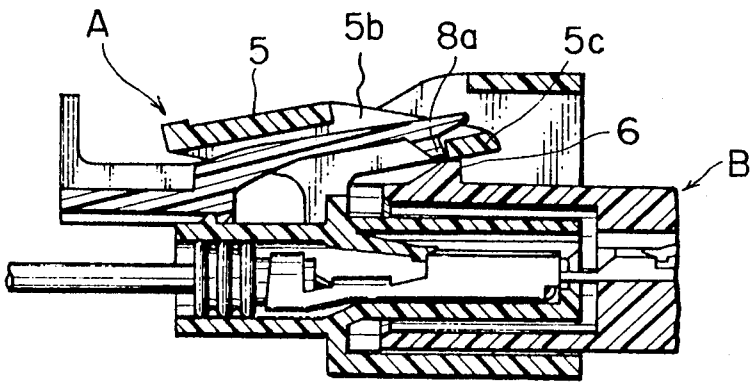
Figure 1D:
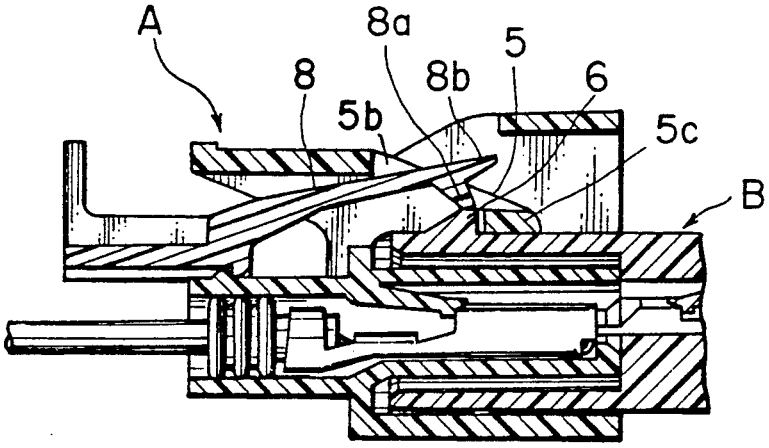
Figure 1E:
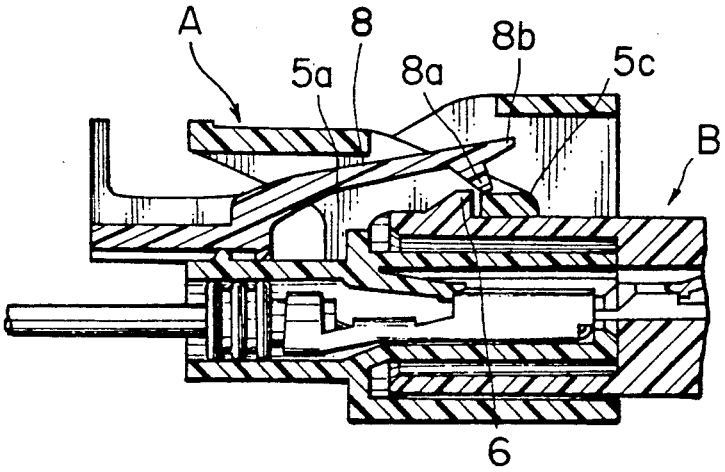
Figure 1F:
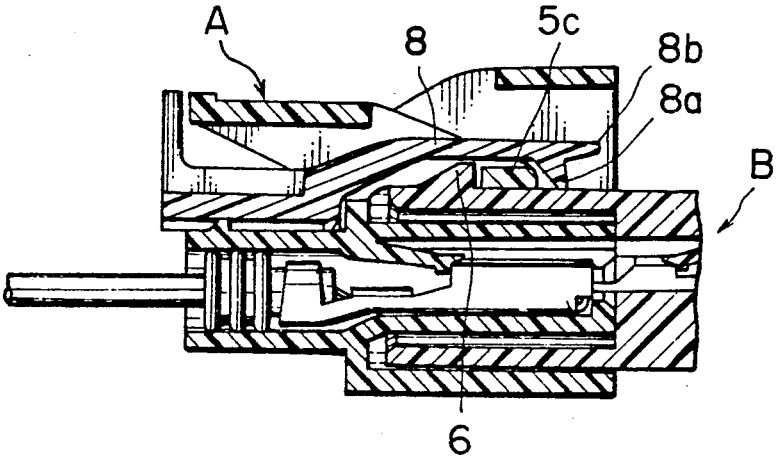

As the male and female connector housings A, B are engaged, the engagement portion 5*c* of the lock arm 5 moves up a tapered guide surface 6*a* of the engagement projection 6 and at the same time the lock detection arm 8 also moves upward (FIGS. 1*b* and 1*c*). When the engagement portion 5*c* rides over the engagement projection 6, the lock arm 5 lowers and the abutment portion 8*a* rests on top of the engagement projection 6. As a result, the lock detection arm 5 is cleared of the restriction from the lock arm 5 and remains inclined upwardly (FIG. 1*d*). In this condition, the lock verification slider E can be moved forwardly, which is a proof that the male and female connectors A', B', are completely engaged.

The description in the foregoing explains the common structure of the male connector housing, the female connector housing and the lock verification slider, which are further detailed in the following embodiments.

Figure 2:
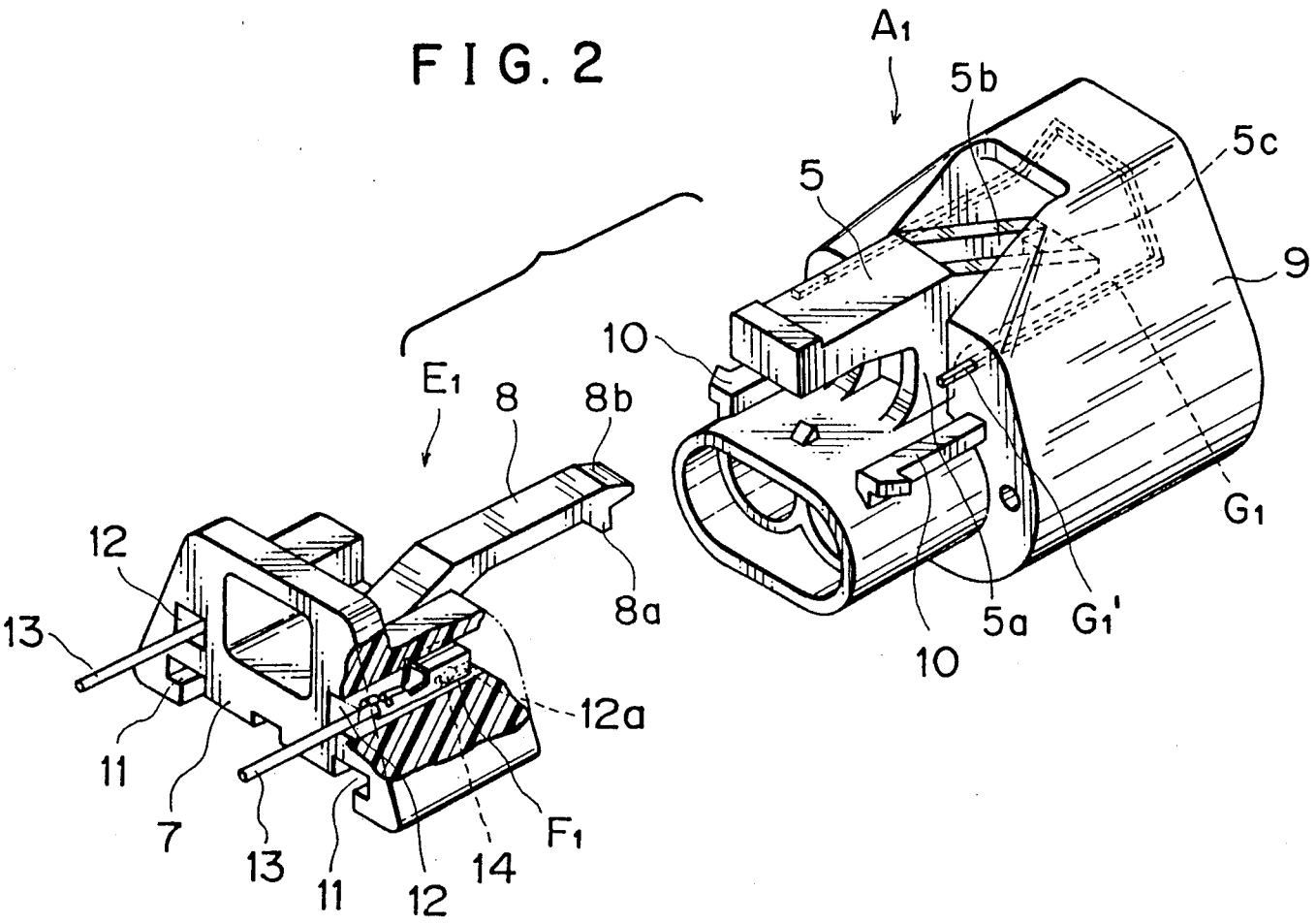
FIG. 2 is a perspective view of one embodiment of this invention showing one of mating connector housings partly cut away.
Figure 3:
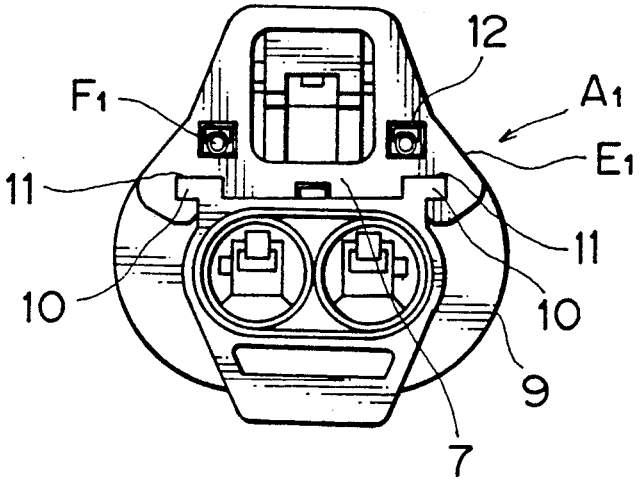
FIG. 3 is a rear view of a first connector housing of FIG. 2.
Figure 4:
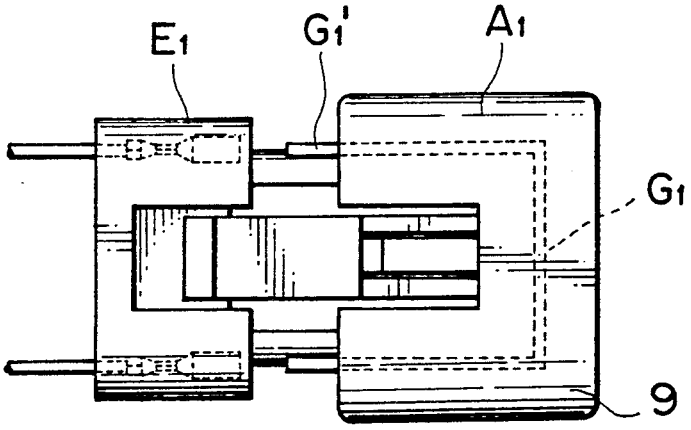
FIG. 4 is a plan view of the first connector housing of FIG. 2.

A male connector housing $A_1$ shown in FIGS. 2 through 4 has a lock verification slider $E_1$, which can be advanced forwardly when the male connector housing $A_1$ is completely connected with a mating female connector housing (not shown). The lock verification slider $E_1$ and the lock arm 5 are engaged through a guide rail structure.

The male connector housing $A_1$ has at the front half thereof an enclosure portion 9 that encloses the mating female connector housing. A pair of rails 10 extend rearwardly from the rear end of the enclosure portion 9. Grooves 11 formed in the lock verification slider $E_1$ on either side of the base portion 7 engage with the rails 10. Also formed in the lock verification slider $E_1$ above the grooves 11 are a pair of terminal accommodating chambers 12 that extend longitudinally therethrough.

A small female terminal $F_1$ for detecting connector engagement that is already attached with a wire 13 is inserted into each of the terminal accommodating chambers 12, with an engagement piece 14 engaged with a step portion 12*a* to prevent the female terminal from slipping off. A short-circuit terminal $G_1$, roughly U-shaped when viewed from above, is embedded in the enclosure portion 9 and has its contact ends $G_1$, projected from the rear end of the enclosure portion 9 to face the engagement detection female terminals $F_1$.

In the above construction, when the two connector housings are completely connected, the lock verification slider $E_1$ can be advanced, at which time the contact ends $G_1'$ of the short-circuit terminal $G_1$ come into contact with the paired engagement detection female terminals $F_1$ to complete the connector engagement detection circuit.

Figure 5:
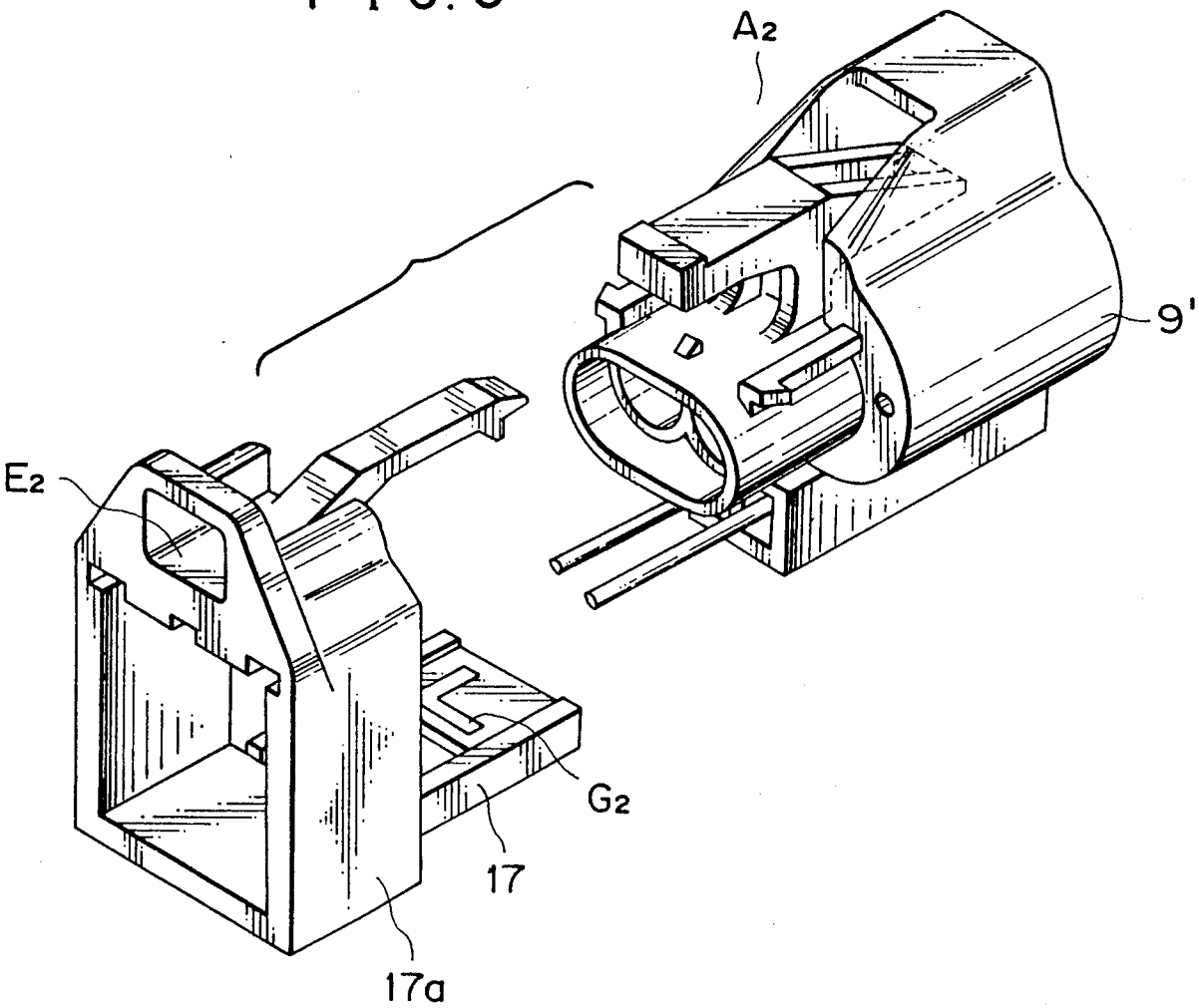
FIG. 5 is a perspective view of a second embodiment of the invention showing a lock verification slider separated from a first connector housing.
Figure 6A:
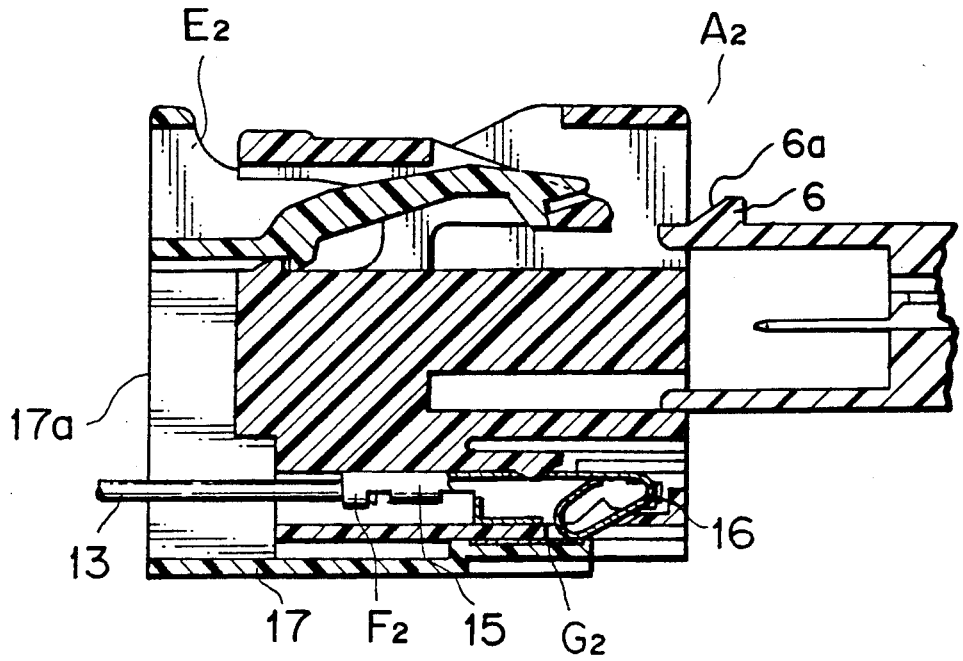
FIGS. 6*a* and 6*b* are cross-sectional views of FIG. 5, with FIG. 6*a* showing the lock verification slider in a retracted position and FIG. 6*b* showing it in an advanced position.
Figure 6B:
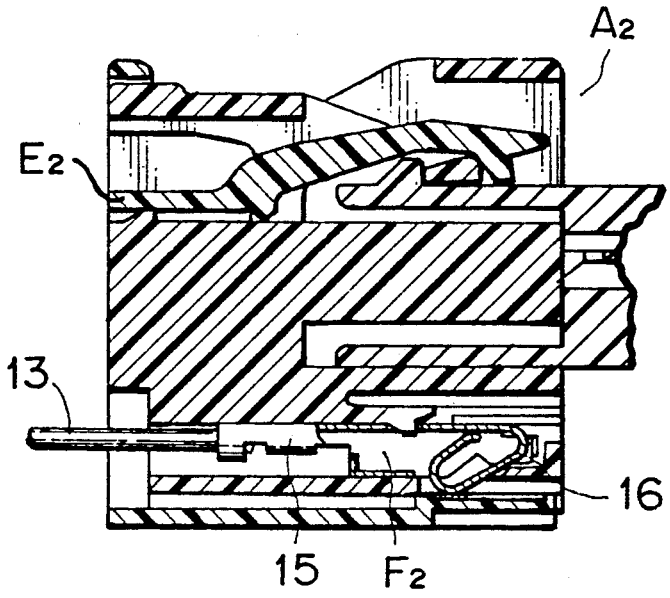
Figure 7A:
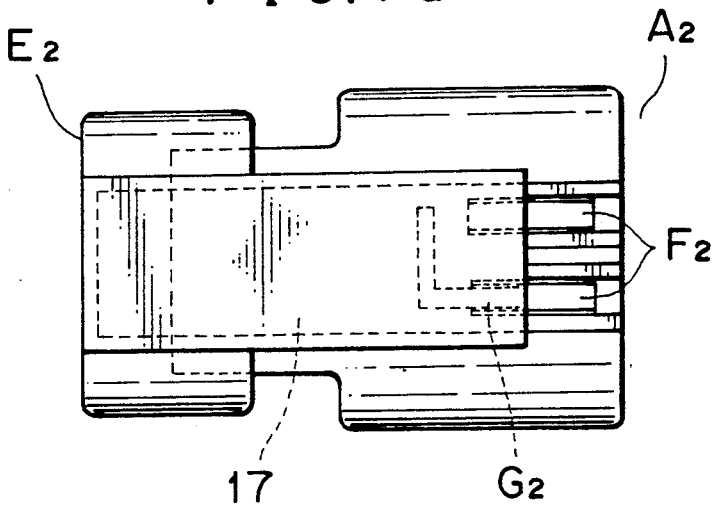
FIGS. 7*a* and 7*b* are bottom views of FIG. 5, with FIG. 7*a* showing the lock verification slider in the retracted position and FIG. 7*b* showing it in the advanced position.
Figure 7B:
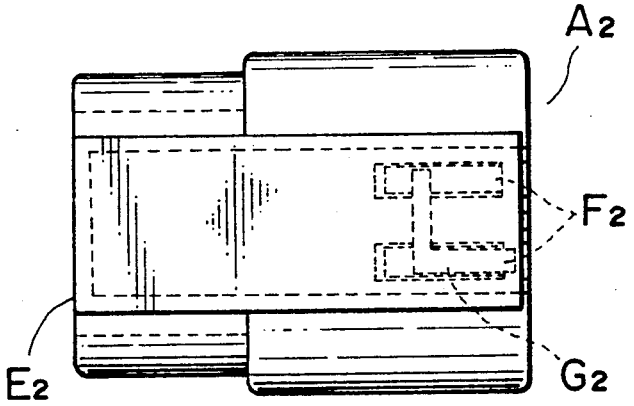

In another embodiment shown in FIGS. 5 to 7, a pair of terminal accommodating chambers 15 are formed in the lower part of the enclosure portion 9', of the male connector housing $A_2$. Inserted and fixed in the terminal accommodating chambers 15 are terminals $F_2$ for connector engagement detection circuit which have elastic contact pieces 16 projecting downwardly through an opening in the enclosure portion 9'.

A lock verification slider $E_2$ is provided, through an annular frame portion 17*a*, with a support plate 17 which has an L-shaped short-circuit terminal $G_2$.

In the above construction, when the male connector housing is not engaged with the mating connector housing, a part of the L-shaped short-circuit terminal $G_2$ is in contact with one of the engagement detection terminals $F_2$ (FIG. 7*a*). With the mating connector housings fully engaged, the lock verification slider $F_2$ is pushed toward the male connector housing $A_2$, bringing the short-circuit terminal $G_2$ into contact with both of the engagement detection terminals $F_2$ to complete the connector engagement detection circuit.

Figure 8:
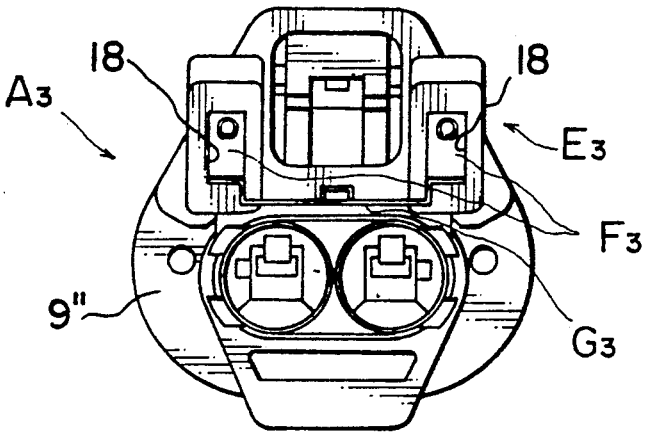
FIG. 8 is a rear view of a third embodiment of the invention.
Figure 9A:
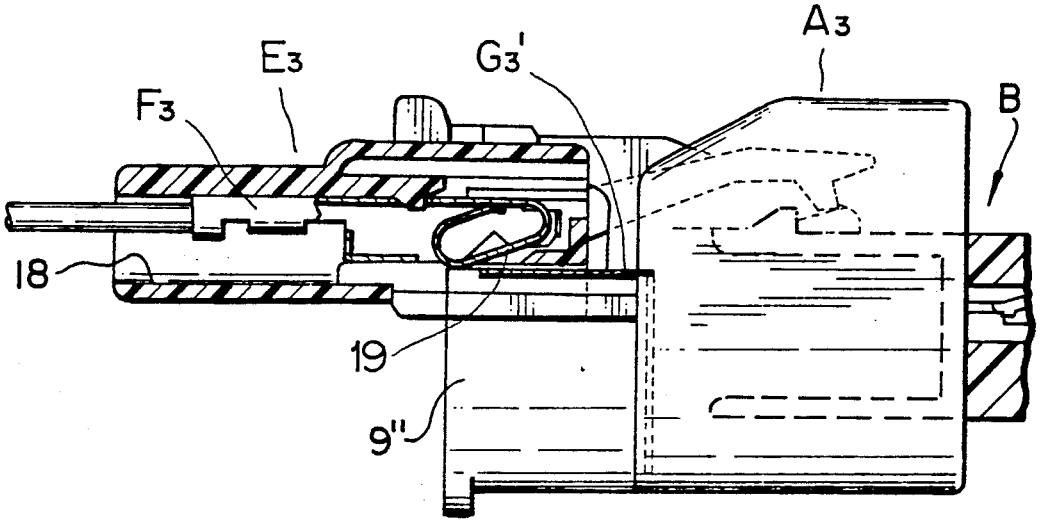
FIGS. 9*a* and 9*b* are cross-sectional views of FIG. 8, with FIG. 9*a* showing the lock verification slider in the retracted position and FIG. 9*b* showing it in the advanced position.
Figure 9B:
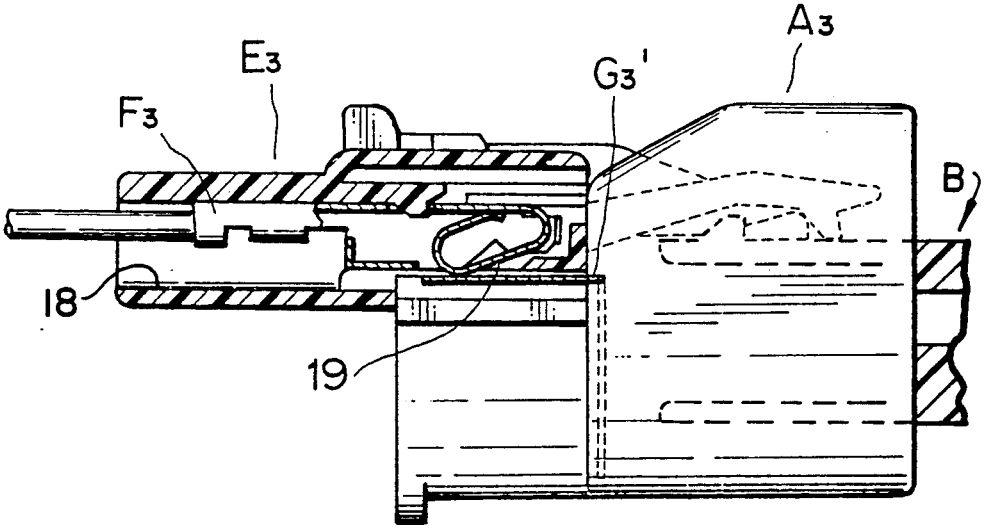

In still another embodiment of FIGS. 8 and 9, a pair of terminal accommodating chambers 18 are formed in the lock verification slider $E_3$. Inserted and fixed in the terminal accommodating chambers 18 are engagement detection terminals $F_3$ whose elastic contact pieces 19 project through openings in the slider $E_3$.

A short-circuit terminal $G_3$ is embedded in an enclosure portion 9'' of the male connector housing $A_3$, with a contact end $G_3'$ projecting toward elastic contact pieces 19.

In the above construction, with the male connector housing completely engaged with the mating connector housing, as the lock verification slider $E_3$ is advanced, the contact end $G_3'$ of the short-circuit terminal $G_3$ comes into contact with the elastic contact pieces 19 of the engagement detection terminals $F_3$, completing the connector engagement detection circuit.

Figure 10:
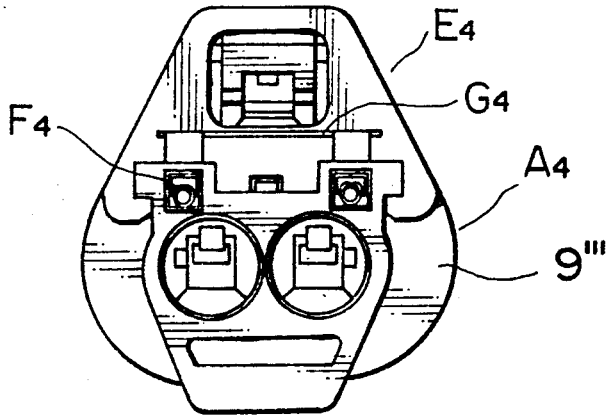
FIG. 10 is a rear view of a fourth embodiment of the invention.
Figure 11A:
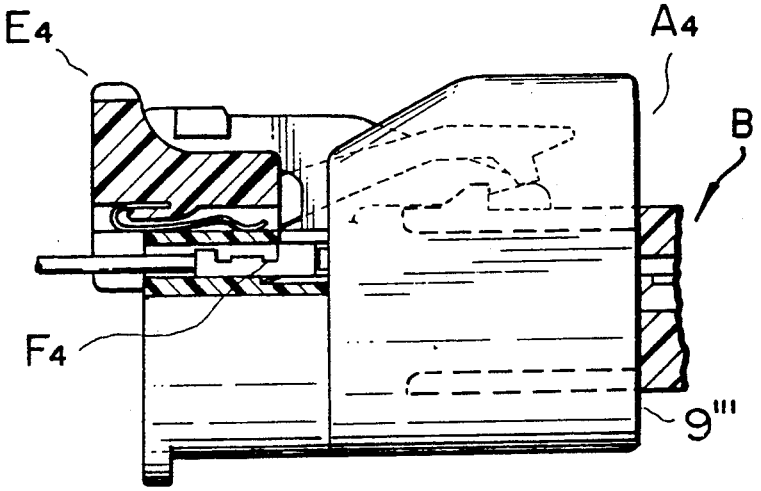
FIGS. 11*a* and 11*b* are cross-sectional views of FIG. 10, with FIG. 11*a* showing the lock verification slider in the retracted position and FIG. 11*b* showing it in the advanced position.
Figure 11B:
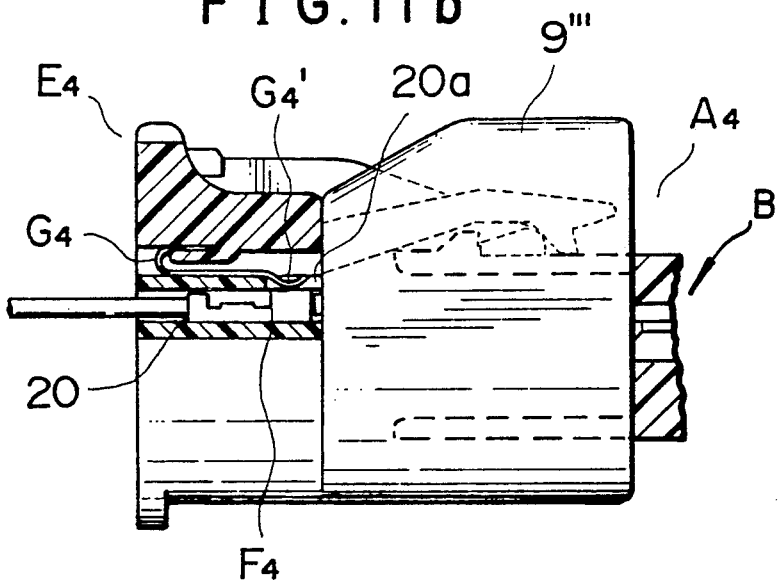

In a further embodiment shown in FIGS. 10 and 11, a pair of terminal accommodating chambers 20 are formed in the rear part of an enclosure portion 9''' of the male connector housing $A_4$. Engagement detection terminals $F_4$ are inserted and fixed in the terminal accommodating chambers 20.

A short-circuit terminal $G_4$ is provided to a lock verification slider $E_4$. With the two mating connector housings completely engaged, when the slider $E_4$ is pushed in, elastic contact ends $G_4'$ of the short-circuit terminal $G_4$ project down through openings 20*a* and engage with the engagement detection terminals $F_4$, completing the connector engagement detection circuit.

The construction and advantages of this invention may be summarized as follows.

One of the mating connector housings has a resilient lock arm and the other connector housing has an engagement portion that cooperates with the resilient lock arm. The first connector housing is also provided with a lock verification slider that can be advanced only when the two connector housings are completely connected. A pair of engagement detection terminals are provided to either the first connector housing or the lock verification slider, and a short-circuit terminal is provided to either the lock verification slider or the first connector housing so that the engagement detection terminals and the short-circuit terminal face each other and, when the lock verification slider is advanced, come into contact with each other. This construction that utilizes the lock verification slider realizes the connector engagement detection circuit without enlarging the connector housing.

What is claimed is:

1. A connector engagement detecting apparatus comprising:

a first connector housing with a resilient lock arm;

a second connector housing with an engagement portion that cooperates with the resilient lock arm of the first connector housing, said first and second connector housings being adapted to be joined together;

a lock verification slider mounted to the first connector housing, said lock verification slider having a lock detection arm and being able to be advanced to a position where one end of said lock detection arm extends beyond said engagement portion only when the two connector housings are completely connected;

a pair of engagement detection terminals provided to one of said first connector housing and said lock verification slider; and a short-circuit terminal provided to the other one of said lock verification slider and said first connector housing so that said short-circuit terminal faces the engagement detection terminals and, when the lock verification slider is advanced to said position, comes into contact with the engagement detection terminals.

2. A connector engagement detecting apparatus as claimed in claim 1, wherein said short-circuit terminal is provided to the first connector housing and said engagement detection terminals are provided to the lock verification slider.

3. A connector engagement detecting apparatus as claimed in claim 1, wherein said short-circuit terminal is provided to the lock verification slider and said engagement detection terminals are provided to the first connector housing.

4. A connector engagement detecting apparatus as claimed in claim 1, wherein said lock verification slider is mounted to the first connector housing through a rail structure.

* * * * *